US006217664B1

(12) United States Patent
Baniel

(10) Patent No.: US 6,217,664 B1
(45) Date of Patent: Apr. 17, 2001

(54) PROCESS FOR TREATING A SUCROSE SYRUP

(75) Inventor: Avraham Baniel, Jerusalem (IL)

(73) Assignee: Tate & Lyle Public Limited Company (GB)

( * ) Notice: Subject to any disclaimer, the term of this patent is extended or adjusted under 35 U.S.C. 154(b) by 0 days.

(21) Appl. No.: 09/331,532

(22) PCT Filed: Dec. 24, 1997

(86) PCT No.: PCT/GB97/03542

§ 371 Date: Oct. 13, 1999

§ 102(e) Date: Oct. 13, 1999

(87) PCT Pub. No.: WO98/29571

PCT Pub. Date: Jul. 9, 1998

(30) Foreign Application Priority Data

Dec. 27, 1996 (IL) ..... 119924

(51) Int. Cl.[7] ..... C13D 3/16; C18J 1/08
(52) U.S. Cl. ..... 127/53
(58) Field of Search ..... 127/48, 53

(56) References Cited

U.S. PATENT DOCUMENTS 2,000,202 5/1935 Vasquez .
2,022,824 12/1935 Reich .
3,174,877 3/1965 Bohrer .
3,325,308 6/1967 Othmer .
4,116,712 9/1978 Othmer .
5,002,614 3/1991 Myagi et al. .
5,454,875 10/1995 Clarke .
6,051,075 * 4/2000 Kochergin et al. ..... 127/42

FOREIGN PATENT DOCUMENTS 983262 2/1965 (GB) .

* cited by examiner

*Primary Examiner*—David Brunsman
(74) *Attorney, Agent, or Firm*—Ostrolenk, Faber, Gerb & Soffen, LLP

(57) ABSTRACT

The present invention provides a fractionation process for treating an aqueous sucrose syrup having, on a dry basis, an initial sucrose content of at least 30 w/w % comprising combining the syrup with a solvent selected from the group consisting of alkanols, ketones, and esters having 3 to 8 carbon atoms and mixtures thereof to form a system having at least two liquid phases in contact with a sucrose-containing solid phase and separating the phases, whereby there are obtained at least two products from the liquid phases, a first of which is characterized by a sucrose content, on a dry basis, greater than the initial content and a second of which is characterized by a sucrose content, on a dry basis, less than the initial content, in addition to a product obtained from the sucrose-containing solid phase.

16 Claims, 1 Drawing Sheet

PROCESS FOR TREATING A SUCROSE SYRUP

This application is a 371 of PCT/GB97/03542 filed Dec. 24, 1997.

The present invention relates to a fractionation process for treating an aqueous sucrose syrup (hereinafter syrup). More particularly, the present invention relates to the treatment of an aqueous sucrose syrup having, on a dry basis, an initial sucrose content of at least 30 w/w %. The syrups of interest are primarily those encountered in the cane sugar and beet sugar industries.

For the purposes of the present invention, these syrups will be treated as consisting of water(W), sucrose(S) and non-sucrose(NS). This last category comprises a large variety of chemical compounds originating in cane sugar and in beet sugar, or formed during processing, and are present in variable amounts in syrups. These comprise, inter alia, carbohydrates other than sucrose, amino acids, proteins, inorganics etc. as reported extensively in the relevant literature. For the purposes of the present invention all of these are included within the term "non-sucrose".

Two examples of typical compositions are listed below:

| Syrup | W | S | NS |
|---|---|---|---|
| blackstrap molasses | 17–25 | 30–40 | 35–53 |
| affination syrup | 26–28 | 63–66 | 4–11 |

The carbohydrates in the non-sucrose (NS) fraction consist primarily of glucose and fructose and are customarily referred to as "Invert". This designation applies to (glucose+fructose), without implying that these are necessarily in equimolar proportions. "Invert" will be used in this sense in the present specification.

In treating syrups for the purpose of upgrading their value through fractionation, the recovery and distribution of the Invert between the fractions may represent an important feature of the process. Thus, since Invert is fully fermentable, it will be a desirable constituent of syrup-derived products directed to fermentation industries. It will be, however, an undesirable constituent of a syrup-derived product intended for further recovery of sucrose by evaporation, since Invert negatively affects sucrose crystallization. One of the useful aspects of the process is the capability it provides in recovering Invert-enriched and Invert-depleted products.

In the text and examples below, whenever figures for Invert (or for glucose and fructose separately), are given they should be understood as representing part of the non-sucrose (NS) of the particular syrup discussed.

As is known, sugar in its purest (and most desirable) form consists of 100% sucrose. In processing cane or beet for sugar the manufacturer naturally strives to approach complete recovery of sucrose in pure form. A large and costly part of processing consists of separating sucrose from non-sucrose by repeated crystallization of sucrose, pushing the non-sucrose into successive mother liquors of increasing contents of non-sucrose which are syrups as defined above. Complete recovery of sucrose by crystallization, however, is not feasible and sucrose in economically significant amounts inevitably reports to low value molasses. This in turn is sometimes subjected to a special separation process, such as chromatography over ion-exchange but the practice has not become universal due to marginal economics.

The foregoing indicates that a simple process to separate syrups into fractions that are either higher in sucrose content than the initial syrup, or lower in sucrose content could be useful in sugar manufacture and refining as well as in molasses upgrading.

Elimination of non-sucrose from a syrup stream in a crystallization sequence of sugar manufacture will obviously improve sucrose recovery. Such elimination need not be complete for the contribution to be significant.

Molasses has uses in which its sucrose content is the main contributor to its value and other uses in which various non-sucroses (such as vitamins and amino acids) are the main contributor to its value. Fractionation of molasses could thus enhance its value by providing products that are tailored to specific end uses.

The present invention provides a simple and effective fractionation of sucrose syrups as postulated above. It is based on the surprising discovery that certain liquid compounds which, per se, are non-solvents of sucrose can be efficient solvents for the fractionation of syrups. Alkanols, ketones and esters were found to be effective compounds in this respect. Particularly useful are alkanols, ketones and esters that have in their molecule a total number of carbon atoms of three to eight.

Thus, according to the present invention, there is now provided a fractionation process for treating an aqueous sucrose syrup having, on a dry basis, an initial sucrose content of at least 30 w/w % comprising combining said syrup with a solvent selected from the group consisting of alkanols, ketones; and esters having 3 to 8 carbon atoms and mixtures thereof to form a system having at least two liquid phases in contact with a sucrose-containing solid phase and separating said phases, whereby there are obtained at least two products from said liquid phases, a first of which is characterized by a sucrose content, on a dry basis, greater than said initial content and a second of which is characterized by a sucrose content, on a dry basis, less than said initial content, in addition to a product obtained from said sucrose-containing solid phase.

The term "sucrose-containing solid phased" as used herein, refers to the fact that during and at the end of the fractionation process varied amounts of sucrose will be found in the solid phase, wherein at the end of the process said amount can be driven down to about 1%.

As will be realized, the present process provides a tool which enables economic decisions as to the amount of sucrose desired in each of the final phases.

In preferred embodiments of the present invention non-sucrose constituents separate into an immiscible phase as described and exemplified hereinafter.

In another preferred embodiment of the present invention, at least one of said phases is a solvent containing liquid phase, which phase is dehydrated to induce preferential precipitation of sucrose therefrom.

In, yet, another preferred embodiment of the present invention, the process is modified by re-combining two products, or more, into a single product.

In especially preferred embodiments of the present invention said solvent is selected from the group consisting of alkanols, ketones, esters having between 3 and 6 carbon atoms and mixtures thereof.

The invention is best understood with reference to the systems formed by sucrose-water-solvent. These systems were found to have specific shared features that are described with reference to FIG. 1. appended hereto.

Therefore, the invention will first now be described in connection with certain preferred embodiments with reference to the following illustrative figure so that it may be more fully understood.

With specific reference now to the FIGURE in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention.

BRIEF DESCRIPTION OF THE DRAWINGS

In the drawings:

In FIG. 1.:

Figure 1:
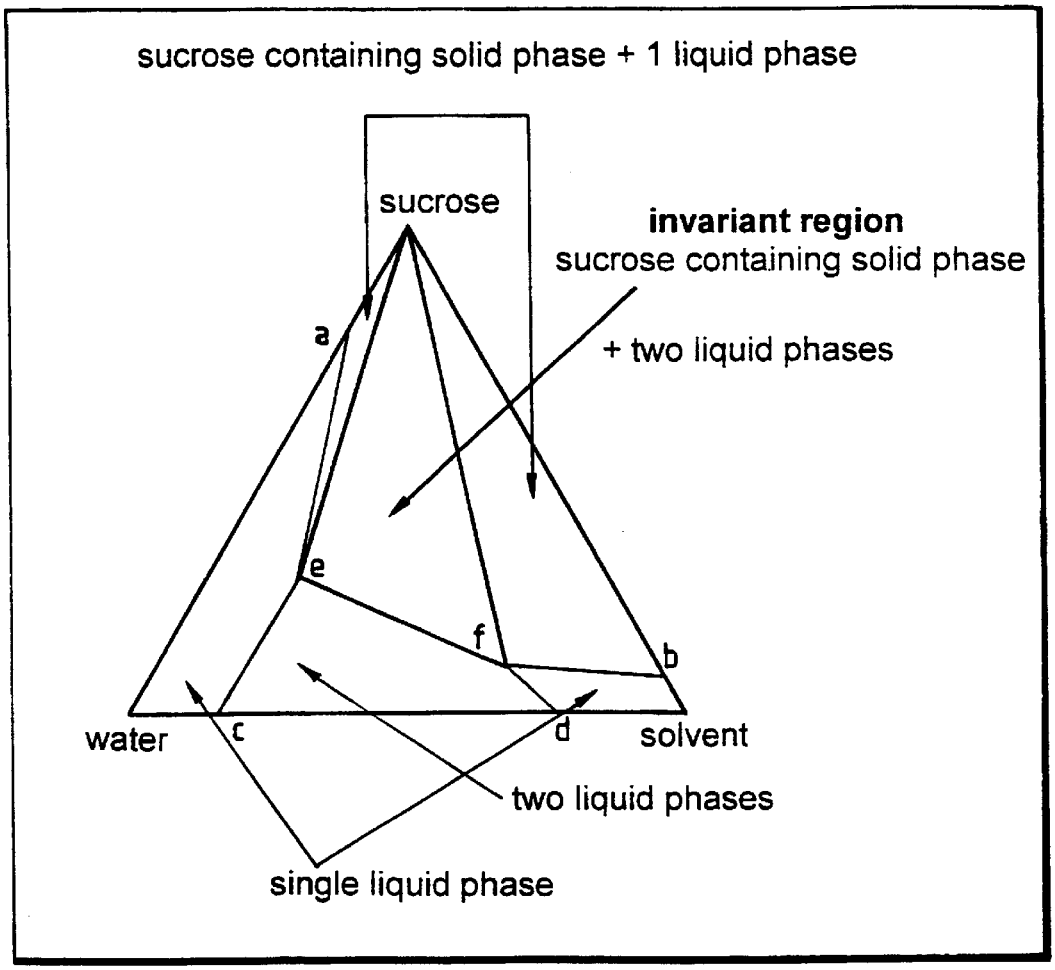
FIG. 1 is an isotherm describing the case that water and solvent are partially miscible at the selected temperature. This covers also the somewhat simpler case of complete waterlsolvent miscibility.

c represents water saturated to solvent; d—solvent saturated to water; (c and d disappear in case of complete miscibility);

cefd is a 2-liquid phase region (that does not exist when complete water/solvent miscibility obtains);

a(water)ce and b(solvent)df are single liquid phase regions;

a (sucrose)ae and (sucrose)bf are regions of sucrose-containing solid phase and one liquid phase of which ae and bf are the saturation curves;

(sucrose)ef is the invariant region; any composition in this region splits into solid S and the two invariant liquid phases represented by e and f.

The terms "complete miscibility" and "partial miscibility" as used in connection with the present invention characterize a solvent strictly with respect to its behavior in systems that contain only the solvent and water and with respect to a defined temperature. As is known, miscibility can change to non-miscibility and vice versa with change in temperature, or in the presence of a third component.

The co-existence of two liquid phases in equilibrium with solid sucrose over wide temperature ranges is a feature that characterizes all the compounds defined as "solvent" with respect to the present invention. Furthermore, these regions are quite large rather than negligibly small as might have been expected from the fact that sucrose is virtually insoluble in compounds claimed as solvents by the present invention. This unexpected aspect of sucrose syrups solubility behavior is brought out in the following table, which provides the invariant compositions e and f for several solvents at 40° C. and 700° C.

TABLE 1

| | 40 C. | | | 70 C. | | |
|---|---|---|---|---|---|---|
| Solvent | solvent | sucrose | water | solvent | sucrose | water |
| $Me_2CO$ light invariant phase | 76.6 | 2.5 | 20.95 | | | |
| $Me_2CO$ heavy invariant phase | 13.85 | 57.55 | 28.6 | | | |
| iPrOH light invariant phase | 67.2 | 11.4 | 21.4 | 73.1 | 9.55 | 17.35 |
| iPrOH heavy invariant phase | 8.7 | 59.2 | 32.1 | 7.85 | 70.2 | 22.05 |
| nPrOH light invariant phase | 78.5 | 4.8 | 16.7 | 78.65 | 6.45 | 14.9 |
| nPrOH heavy invariant phase | 4.3 | 65.9 | 29.8 | 5.9 | 70 | 24.1 |
| iBuOH light invariant phase | 89.65 | 0.65 | 9.65 | 89.6 | 1.45 | 9 |
| iBuOH heavy invariant phase | 2.1 | 67.9 | 30 | 2.1 | 73.15 | 24.35 |

TABLE 1-continued

| | 40 C. | | | 70 C. | | |
|---|---|---|---|---|---|---|
| Solvent | solvent | sucrose | water | solvent | sucrose | water |
| nBuOH light invariant phase | 87.05 | 0.95 | 12.1 | 88.7 | 1.7 | 9.7 |
| nBuOH heavy invariant phase | 2.1 | 68.8 | 28.1 | 2.2 | 72.4 | 25.4 |
| EtOAc light invariant phase | 95.8 | 0.765 | 3.435 | 94 | 1.44 | 4.35 |
| EtOAc heavy invariant phase | 2.4 | 69.1 | 28.5 | 0.5 | 76.1 | 23.4 |
| nPrOAc light invariant phase | 96.5 | 0.175 | 3.35 | 95.3 | 0.095 | 4.6 |
| nPrOAc heavy invariant phase | 0.5 | 70.9 | 28.6 | 0.3 | 77 | 22.7 |

As can be clearly seen from Table 1, the light invariant phase and the heavy invariant phase in equilibrium provide completely novel means of distributing sucrose between liquid phases. The compositions of these two equilibrium liquid phases, for the solvents considered, are unique and novel. Nothing in prior art could teach the selectivities with respect to sucrose nor the sucrose distribution between these liquid phases. The same applies to non-sucrose compounds commonly found in syrups and their distributions relative to sucrose. All that an engineer would need for this purpose are one or a few isotherms that, if not comprised in the table above, are easy to establish experimentally.

A particularly useful feature of a large invariant zone is that it provides for a predictable distribution of sucrose between a sucrose-containing solid phase and two liquid phases by means of a single operation consisting of mixing the syrup with a calculated amount of solvent and allowing the phases to separate. Naturally, non-sucrose constituents present in a sucrose syrup will also distribute between the phases and thereby change their compositions, however the reference system water-sucrose-solvent provides a guide that allows to determine an optimal procedure by a few experiments.

In a preferred embodiment of the present invention, the process can be further refined and modified to comprise combining said syrup with said solvent to form a system having at least two liquid phases, separating said phases and combining at least one of said phases with additional solvent to form therefrom a system having at least two further liquid phases, separating said further phases and removing said solvent therefrom, whereby there are obtained at least two products from said liquid phases, a first of which is characterized by a sucrose content on a dry basis greater than said initial content and a second of which is characterized by a sucrose content on a dry basis less than said initial content.

A further interesting feature of these solvents is that they form with glucose and with fructose systems which are generally similar to those which they form with sucrose analogous to the phase diagram of FIG. 1. As for sucrose, the solubilities in dry solvents are low. However, both glucose and fructose (or more generally, Invert as encountered in industrial sugar recovery and refining), are more soluble than sucrose. This distinguishing feature of Invert vs. Sucrose provides for separation and recovery options between these two components.

It is noteworthy that an invariant zone for the system water-sucrose-acetone was already observed in 1904 and the isotherm for 25° C. was described in detail by W. Herz & al in Z. Anorg. Chemie, 4A1 p.309, 1904 and has been reproduced in the common handbook Seidell, Solubility of Inorganic and Organic Compounds the first edition of which dates to 1907. A literature survey found no continuation of this line of investigation with respect to other solvents. As the review of prior art further below indicates, inventors claiming solvent-based processes for syrup purification failed to use the potentialities of the invariant zone even with acetone as solvent.

Sugar manufacture is an old industry of over 200 years. Recorded proposals to use solvents in the operations of this industry are relatively few and none has become established practice. The present invention differs fundamentally from these proposals as will be realized from the following brief review of relevant prior art patents.

Paulsen (U.S. Pat. No. 26,050 of 1859) proposes the use of ethanol/water mixtures as a solvent to dissolve sucrose and reject non-sucrose constituents (and thereby facilitate recovery.

Clarke (U.S. Pat. No. 5,454,875 of 1995) also proposes the use of EtOH to precipitate impurities from molasses in combination with additional operations.

Othmer (U.S. Pat. No. 4,116,712 of 1978) also proposes the use of ethanol as the key component in ethanol/acetone mixtures proposed as solvent for the extraction of impurities.

Thus, over a span of some 150 years, ethanol has been considered as a solvent of choice and ways were sought for its application in economically effective way—unsuccessfully.

The system water-sucrose-ethanol does not form an invariant zone at any temperature studied thus far. At any given temperature the solubility of sucrose in water-ethanol mixtures decreases as the ratio of ethanol to water increases. This decrease of solubility is perfectly continuous from 0% to 100% of EtOH in the EtOH/water mixture. For this reason, ethanol, which has been suggested as the solvent of choice in the prior art patents is totally distinguishable from the solvents of the present invention in that, as describe and claimed herein, the solvents used in the present invention, constitute systems characterized by extensive invariant zones.

While ethanol as used in the prior art does permit the selective precipitation of inorganics and some non-sucrose organics, this requires a proportion of ethanol to water of at least 1.2:1 (see Clarke). Thus the syrup of Ex.1 hereinafter, containing 21.3% water, would require the addition of some 30 grs ethanol per 100 grs syrup to achieve results similar to those obtained by means of just 7 grs nPrOH. Obviously, further separation, such as described in examples 3 to 7 hereinafter, are inherently impossible with ethanol.

It is interesting to note that Othmer in U.S. Pat. No. 4,116,712 issued in September of 1978, reviews the state of the prior art as follows:

"For many years sugar refiners have tried to use ethanol in the affination of raw sugar without success, and for the liquid-liquid extraction of other solids, i.e. various impurities, away from a sugar syrup in a final molasses.

For example, Vazquez in U.S. Pat. No. 2,000,202 treated a concentrated molasses with a nearly anhydrous ethanol mixed with a second liquid such as ethyl acetate. This combination dissolved the impurities and precipitated or crystallized the sugar out in a mass or massecuite of crystals. The alcohol and impurities were removed as an extract molasses containing the impurities; and the sugar crystals were then later dissolved with more dilute alcohol from the insoluble impurities which remained.

Alcohol has been found to be a poor solvent for many of the impurities while it is, as noted in Vazquez, when somewhat diluted, a good solvent for the sugar—thus no industrial use has been reported of systems base on its use as: (a) an afination solvent, (b) an extraction liquid for impurities from a syrup or molasses, or (c) for precipitating crystals of sugar and washing them, then dissolving them as suggested in U.S. Pat. No. 2,000,202.

Bohrer U.S. Pat. No. 3,174,877 used methanol with 1 to 5% of a hydrocarbon to decolorize raw sugar in an affination, and showed that ethanol was definitely unusable for this purpose. His solvent was not chosen to remove other impurities of raw sugar, with which U.S. Pat. No. 3,174,877 was unconcerned.

Leonis U.S. Pat. No. 1,558,554 dried molasses and treated this with glacial acetic acid for 2 to 24 hours during which time the impurities evidently went into solution, the sugar was precipitated; and the impurities remained in the mother liquid.

Othmer U.S. Pat. No. 3,325,308 washed sugar crystals with pure methanol or pure acetic acid, separated the impurities in an extract molasses, removed the solvent therefrom; and then, out of this molasses, extracted with acetone the oils, fats and waxes for which the acetone has an excellent selectivity."

Seventeen years later, Clarke, in U.S. Pat. No. 5,454, 875 issued in October 1995, reviewed the state of the art as follows:

"U.S. Pat. No. 5,002,614 describes a process for extracting cane wax from molasses with an alcohol solvent.

U.S. Pat. No. 4,116,712 describes a process for removing impurities from sugar crystals and syrups by a liquid/liquid phase extraction using a mixture of two solvents, with at least part of the extraction operation preferably being conducted at a pH of 1.25 to 1.30. The preferred solvents are ethanol or acetic acid in combination with acetone. After extractions time and later carbon dioxide may be added to adjust the pH.

U.S. Pat. No. 3,876,466 discloses reducing the viscosity of a sugar solution by adding aromatic organic sulphonic acids, their or derivatives.

U.S. Pat. No. 3,781,174 discloses the production of refined sugar from raw cane juice by continuous carbonation, with active carbon and a combination of ion-exchange resins and ion-xchange membrane electrodialysis.

U.S. Pat. No. 3,734,773 discloses the purification of sugar beet diffusion juice, with recovery of certain organic acids as a by-product, in which carbon dioxide or carbonate ions in hot water are used to precipitate calcium carbonate.

U.S. Pat. No. 3,563,799 discloses the purification of dilute sugar-containing liquids by concentration of the liquid, demineralization in a mixed resin ion-exchange; further concentration, and filtration.

U.S. Pat. No. 3,325,308 discloses the removal of impurities from raw sugar with three successive solvent extraction systems. Methanol is the preferred first solvent, acetone the preferred second solvent, and water the preferred third solvent.

U.S. Pat. No. 2,640,851 discloses the recovery of alkaline earth aconitates from blackstrap molasses through a process using the addition of lime and calcium chloride at high temperatures.

U.S. Pat. No. 2,379,319 discloses the removal of impurities from sugar beet diffusion juice by treatment with a proteolytic enzyme, followed by addition of lime and carbonate.

U.S. Pat. No. 2,043,911 discloses the removal of sulphite impurities and added during the manufacture of sugar by adding an oxidizing agent.

U.S. Pat. No. 2,000,202 discloses the recovery of sugar from molasses by adding ethanol and sulphuric acid to remove organic acids, followed by precipitating the sugar with another organic solvent, such as ethyl acetate."

As will be realized, none of said references taught or suggested the present fractionation process based on the use of the solvents defined herein for treating an aqueous sucrose syrup, to form a system having, at least, two liquid phases in contact with a solid sucrose phase and the advantages obtainable therewith.

It has also surprisingly been found that the addition of solvent to syrup in amounts just sufficient to induce the formation of two liquid phases can already serve a very useful purpose by precipitating non-sucrose constituents. The separation of such precipitates from the saturated aqueous phase, just saturated by solvent, is easy and can result in a useful separation, per se, as well as result in significant upgrading of the products obtained in subsequent manipulations of the syrup according to the present invention, whereby products richer in sucrose than the starting syrup and products poorer in sucrose than the starting syrup are obtained.

The invention makes it possible to separate dextrose and fructose, from sucrose with surprising simplicity. Dextrose and fructose are frequently lumped under the name of "Invert" in the sugar industry without necessarily designating an equimolar mixture. This name will also be used herein as a matte of convenience. At present such separation is generally achieved laboriously by multiple crystallizations—a major cost in sucrose production. The difficulties of separations between dextrose, fructose and sucrose have always been understood and explained as due to the similarities between these carbohydrates. The ease of achieving a substantial separation by the present invention was thus totally unexpected.

Thus, in a preferred embodiment, the present invention also provides a fractionation process, as herein defined, wherein the ratio of invert to sucrose in one of the liquid phases is lower than in the syrup treated and the ratio of invert to sucrose in the other liquid phase is higher than in the syrup treated.

While the invention will now be described in connection with certain preferred embodiments in the following examples so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following examples which include preferred embodiments will serve to illustrate the practice of this invention, it being understood that the particulars shown are by way of example and for purposes of illustrative discussion of preferred embodiments of the present invention only and are presented in the cause of providing what is believed to be the most useful and readily understood description of formulation procedures as well as of the principles and conceptual aspects of the invention.

EXAMPLE 1

A syrup (1) internal to cane sugar refining had a very dark color and the composition tabulated below.

| | | | |
|---|---|---|---|
| | Solids 78.7 | | Water 21.3 |
| | 100 Solids (dry basis) | | |
| Sucrose 85.8 | Non-sucrose 14.2 | | |
| | Invert | Non-carbohydrates 7.4 | |

100 grs of (1) were mixed at 40° C. with 4 grs nPrOH; the mixture was poured into a graduated cylinder and had the volume of 92 ml; there was no evident separation of solids visible; the material was remixed with additional 3 grs of nPrOH whereupon the separation of abundant solids was in evidence and when allowed to stand for a time it settled into a lower dark slurry layer and an upper light-colored layer above which a very small ring of an even lighter solvent layer was just visible. After separation of the bottom layer from the aqueous layer above it (together with the minor solvent layer) and removal of the nPrOH by distillation, a dark colored syrup and a light colored syrup were obtained, which, on a dry basis, contained respectively 24% of total solids at 72.2% sucrose and 76% of total solids at 90.2% sucrose.

EXAMPLE 2

100 grs of blackstrap molasses was mixed with 6 grs nBuOH at 90° C., allowed to settle, separated and desolventised to obtain two products which, on a dry basis, were about equal in weight and contained 23% sucrose and 47% sucrose, respectively.

EXAMPLE 2a 100 grs of the same molasses as used for Example 2 were contacted with 400 grs solvent consisting of 320 grs n-propanol and 80 grs water at 80° C., as in the first contact and the solvent layers combined.

The combined solvent layers were contacted with 10 grs active-carbon and filtered, whereby they turned from a very dark color to light-brown liquid. After distillation of the solvent, a honey-brown syrup was obtained. It contained 95% of the invert and 82% of the sucrose in the molasses, subjected to this two-stage cross-extraction.

EXAMPLE 2b

The same as Example 2a only instead of 5 grs active carbon, the treatment was made by 10 grs of Fuller earth (such as commonly used in the oil industry). Decolorisation nearly equal to that of active carbon was achieved.

EXAMPLE 3

100 grs of the same syrup as in example 1 were treated at 75° C. with nPrOH in a two step operation. The first step was mixing with the solvent separated in the second step and then the settled layer from this step was mixed, in a second step, with Bgrs nPrOH and separated. The upper layer from the first step and the bottom layer of the second step were desolventised into a light and dark products respectively. The compositions of the products of Examples 1&3 are compared, on a dry basis, below.

| Product | % of total | % sucrose | % non-sucrose |
|---|---|---|---|
| Exs. 1, light colored | 76 | 90.2 | 9.8 |
| Exs. 1, dark colored | 24 | 72.2 | 27.8 |
| Ex. 3, light colored | 85.2 | 91.7 | 9.3 |
| Ex. 3, dark colored | 14.8 | 52 | 48 |

EXAMPLE 4

100 grs of the same syrup as in Ex.3 were treated as in Ex.3 with the difference that the light colored liquid phase, separated from the first mixing operation, was mixed with a further 80 grs of nPrOH at the same temperature. An abundant white precipitate formed, which was filtered, and which on analysis was found to consist of virtually pure sucrose. On removal of solvent the three fractions collected were as shown in the following table:

| Ex. 4 Product | % of total | % sucrose | % non-sucrose |
|---|---|---|---|
| dark colored precipitate | 14.8 | 52 | 48 |
| light colored precipitate | 51.3 | >99 | <1 |
| light colored solvent phase | 33.9 | 80.5 | 19.5 |

EXAMPLE 5

100 grs of the same syrup used in the previous example were mixed with 5 grs nBuOH at 80° C. and the mixture was centrifuged. A dark solid mass settled in which one could perceive sucrose crystals. The solids were separated from the liquid phase, re-slurried with 100 nBuOH and separated by centrifugation and the solvent phase mixed with the liquid phase of the previous operation. Three easily perceived phases formed: a nearly colorless solid sucrose, a heavy aqueous phase and a light solvent phase (the latter two deriving obviously from the invariant phases of the corresponding water-sucrose-nBuOH system). The aqueous layer containing the solid sucrose is separated as a single product from the solvent phase. After desolventising the amounts and compositions of the three fractions were as shown in the following table:

| Ex. 5 Product | % of total | % sucrose | % non-sucrose |
|---|---|---|---|
| 1st precipitate, dark colored | 11.4 | 36 | 65 |
| 2nd precipitate + aqueous phase, light colored | 80 | 98 | 2 |
| Residual product, light colored | 8.6 | 22 | 79 |

EXAMPLE 6

The solvent layer obtained in Ex.4 is desolventised in two stages. In the first stage water is removed by distilling out a water/nPrOH azeotrope. Sucrose which has a very low solubility in nPrOH, and a low solubility in all of the "solvents" of the present invention, precipitates and is collected. After desolventising, the light colored solvent that contained 33.9% of total solids provides, 25% of solids at >99% sucrose, and 8.9% of solids at about 26% sucrose, 84% being substantially Invert.

The foregoing examples demonstrate the versatility, which the present process provides, for fractionating syrups into products varying in sucrose contents, as well as in the nature of the non-sucrose. The wide range of temperatures and the choice of solvents provide also for optimization of recoveries, savings in energy etc. that will be obvious to the practicing technician.

The comments below with regard to the above examples and the ramifications thereof, illustrate this point.

In Example 1 the precipitate contains primarily "Ash", a term in common use in the industry to refer generally to inorganics and non-carbohydrate organics as the non-sucrose components since the Invert accompanies the sucrose into solution and is in fact more soluble in the solvents than sucrose itself;

Example 2 illustrates that by choice of temperature and of solvent it is possible to determine the amount of solvent employed as well as other obvious factors. Thus, e.g., in the present case, the higher temperature lowers the viscosity of the highly viscous molasses thereby providing for operational requirements;

Examples 2a and 2b illustrate decolorising solvent extracts so as to obtain light-colored syrup products. This is advantageous since decolorising syrups directly is impractical;

Example 3 introduces a counter-current operational feature thereby achieving a higher recovery of sucrose than in the former two examples and also a better separation between Ash and Organics (that accompany the dark fraction) and Invert—that accompanies the sucrose;

Example 4 illustrates separations achievable by a succession of adjusted additions of solvent. In fact, the described operation can be further extended to achieve considerable separation between sucrose and Invert as described in Example 6 above.

Example 5 achieves approximately the results of Example 4 and Example 6 combined by the use of nBuOH rather than nPrOH and a higher operational temperature.

It will be evident to those skilled in the art that the invention is not limited to the details of the foregoing illustrative examples and that the present invention may be embodied in other specific forms without departing from the essential attributes thereof, and it is therefore desired that the present embodiments and examples be considered in all respects as illustrative and not restrictive, reference being made to the appended claims, rather than to the foregoing description, and all changes which come within the meaning and range of equivalency of the claims are therefore intended to be embraced therein.

I claim:

1. A fractionation process for treating an aqueous sucrose syrup having, on a dry basis, an initial sucrose content of at least 30 w/w % comprising combining said syrup with a solvent selected from the group consisting of alkanols and esters having 3 to 8 carbon atoms and mixtures thereof to form a system having at least two liquid phases in contact with a sucrose-containing solid phase and separating said phases into at least one solvent phase and at least one aqueous phase, whereby there are obtained at least two products from said liquid phases, a first of which is characterized by a sucrose content, on a dry basis, greater than said initial content and a second of which is characterized by a sucrose content, on a dry basis, less then said initial content, in addition to a product obtained from said sucrose-containing solid phase.

2. A fractionation process according to claim 1 in which said solvent or additional solvent is n-propanol.

3. A fractionation process according to claim 1, wherein non-sucrose constituents separate into an immiscible phase.

4. A fractionation process according to claim 3, in which said solvent or additional solvent is n-propanol.

5. A fractionation process according to claim 1, wherein said solvent is selected from the group consisting of alkanols having between 3 and 6 carbon atoms and mixtures thereof.

6. A fractionation process according to claim 5, in which said solvent or additional solvent is n-propanol.

7. A fractionation process according to claim 1, wherein said solvent is removed from a separated liquid phase by distillation.

8. A fractionation process according to claim 7, in which said solvent or additional solvent is n-propanol.

9. A fractionation process according to claim 1, wherein the ratio of invert to sucrose in said aqueous phase is lower than in the syrup treated and the ratio of invert to sucrose in the said solvent phase is higher than in the syrup treated.

10. A fractionation process according to claim 9, in which said solvent or additional solvent is n-propanol.

11. A fractionation process according to claim 1, comprising combining said syrup with said solvent to form a system having at least two liquid phases, separating said phases and combining at least one of said phases with additional solvent to form therefrom a system having at least two further liquid phases, separating said further phases, whereby there are obtained at least two products from said liquid phases, a first of which is characterized by a sucrose content on a dry basis greater than said initial content and a second of which is characterized by a sucrose content on a dry basis less than said initial content.

12. A fractionation process according to claim 11, in which said solvent or additional solvent is n-propanol.

13. A fractionation process according to claim 1, wherein at least one of said phases is a solvent containing liquid phase, which phase is dehydrated to induce preferential precipitation of sucrose therefrom.

14. A fractionation process according to claim 13, in which said solvent or additional solvent is n-propanol.

15. A fractionation process according to claim I comprising recombining said at least two products into a single product.

16. A fractionation process according to claim 15, in which said solvent or additional solvent is n-propanol.

* * * * *